US011279013B2

(12) United States Patent
Jaskot et al.

(10) Patent No.: US 11,279,013 B2
(45) Date of Patent: Mar. 22, 2022

(54) DRIVER REBOUND PLATE FOR A FASTENING TOOL

(71) Applicant: BLACK & DECKER INC., New Britain, CT (US)

(72) Inventors: Erin Elizabeth Jaskot, Richmond, VA (US); Stuart E. Garber, Towson, MD (US); Dustin L. DeMarr, Nottingham, MD (US)

(73) Assignee: Black & Decker, Inc., New Britain, CT (US)

( * ) Notice: Subject to any disclaimer, the term of this patent is extended or adjusted under 35 U.S.C. 154(b) by 277 days.

(21) Appl. No.: 15/637,720

(22) Filed: Jun. 29, 2017

(65) Prior Publication Data

US 2018/0001454 A1 Jan. 4, 2018

Related U.S. Application Data

(60) Provisional application No. 62/356,999, filed on Jun. 30, 2016, provisional application No. 62/357,511, filed on Jul. 1, 2016.

(51) Int. Cl.
*B25C 1/00* (2006.01)
*B25C 1/06* (2006.01)

(52) U.S. Cl.
CPC ..... *B25C 1/008* (2013.01); *B25C 1/06* (2013.01)

(58) Field of Classification Search
CPC B25C 1/008; B25C 1/006; B25C 1/06; B25C 5/15; B25C 5/10
USPC ..... 173/90
See application file for complete search history.

(56) References Cited

U.S. PATENT DOCUMENTS

| | | | |
|---|---|---|---|
| 1,526,025 | A | 2/1925 | Street |
| 2,594,605 | A | 4/1952 | Zoppelt |
| 2,745,689 | A | 5/1956 | Balint et al. |
| 2,822,698 | A | 2/1958 | Gross |
| 2,979,725 | A | 4/1961 | Wandel et al. |
| 3,172,124 | A | 3/1965 | Kremiller |

(Continued)

FOREIGN PATENT DOCUMENTS

| | | | |
|---|---|---|---|
| DE | 29917830 | U1 | 3/2000 |
| EP | 218778 | B1 | 11/1990 |

(Continued)

OTHER PUBLICATIONS

S.S. Sharma, Effect of Heat Treatment on Mechanical Properties of AISI 4147 Spring Steel, Apr. 29-30, 2013. (Year: 2013).*

(Continued)

*Primary Examiner* — Valentin Neacsu
*Assistant Examiner* — Jacob A Smith
(74) *Attorney, Agent, or Firm* — Rhonda Barton

(57) ABSTRACT

A driver rebound plate to prevent a fastener driver from rebounding into the drive path and striking additional fasteners at the end of a drive cycle. The driver rebound plate is formed from an elongated body having a mounting portion at a first end and a bearing portion at a second end. A retaining portion is disposed between the mounting portion and the bearing portion and is adjacent to the mounting portion. An impact portion designed to receive the impact of a driver during a return stroke is disposed between the retaining portion and the bearing portion. The impact portion is bent at an oblique angle with respect to the drive axis.

15 Claims, 6 Drawing Sheets

(56) References Cited

U.S. PATENT DOCUMENTS 3,225,443 A 12/1965 Young
3,480,210 A 11/1969 Perrinjaquet
3,563,438 A 2/1971 Doyle et al.
3,570,739 A 3/1971 Volkmann et al.
3,603,281 A 9/1971 Froelich
3,658,229 A 4/1972 Pomeroy
3,659,768 A 5/1972 Brunelle
3,743,159 A 7/1973 Schneider
3,765,588 A 10/1973 Frederickson
3,768,846 A 10/1973 Hensley et al.
3,774,293 A 11/1973 Golsch
3,820,705 A 6/1974 Beals
3,827,822 A 8/1974 Converse
3,890,058 A 6/1975 Self et al.
3,893,610 A 7/1975 Smith
3,979,040 A 9/1976 Denin
4,033,499 A 7/1977 Butler
4,049,181 A 9/1977 Kametaki
4,129,240 A 12/1978 Geist
4,186,862 A 2/1980 Klaus
4,197,974 A 4/1980 Morton et al.
4,230,249 A 10/1980 Nasiatka et al.
4,270,587 A 6/1981 Ludy
4,270,687 A 6/1981 Maurer
4,304,349 A 12/1981 Novak et al.
4,313,552 A 2/1982 Maurer
4,314,782 A 2/1982 Beekenkamp
4,316,513 A 2/1982 Harris
4,389,012 A 6/1983 Grikis et al.
4,403,725 A 9/1983 Lawrence
4,404,894 A 9/1983 Oesterle
4,416,172 A 11/1983 Medinger
4,424,929 A 1/1984 Weis
4,468,159 A 8/1984 Oster
4,485,952 A 12/1984 Weis
4,487,355 A 12/1984 Ginnow et al.
4,519,535 A 5/1985 Crutcher
4,558,811 A 12/1985 Klaus
4,566,621 A 1/1986 Becht
4,597,517 A 7/1986 Wagdy
4,667,747 A 5/1987 Falls et al.
4,765,786 A 8/1988 Krogh
4,807,793 A 2/1989 Ghibely
4,834,342 A 5/1989 Padgett
4,854,393 A 8/1989 Palet
4,863,089 A 9/1989 McCardle et al.
4,912,848 A 4/1990 Bidanset
4,967,623 A 11/1990 Jackson
5,025,968 A 6/1991 Nasiatka
5,074,453 A 12/1991 Tachihara et al.
5,134,812 A 8/1992 Hoffman et al.
5,165,827 A 11/1992 Miller
5,192,012 A 3/1993 Schafer et al.
5,261,588 A 11/1993 Lin
5,297,886 A 3/1994 Jansen et al.
5,368,213 A 11/1994 Massari
5,405,071 A 4/1995 Baugus
5,462,127 A 10/1995 Svensson
5,478,002 A 12/1995 Clement et al.
5,484,094 A 1/1996 Gupta
5,495,973 A 3/1996 Ishizawa et al.
5,575,051 A 11/1996 Moore
5,588,577 A 12/1996 Chen
5,647,525 A 7/1997 Ishizawa
5,649,661 A 7/1997 Masuno et al.
5,683,024 A 11/1997 Eminger et al.
5,695,108 A 12/1997 Lee
5,711,471 A 1/1998 White
5,779,145 A 7/1998 Zelle et al.
5,782,395 A 7/1998 Sauer
5,813,588 A 9/1998 Lin
5,816,468 A 10/1998 Yang
5,831,817 A 11/1998 Chang
5,921,562 A 7/1999 Robison
5,931,364 A 8/1999 Dennis
6,036,072 A 3/2000 Lee
6,053,389 A 4/2000 Chu et al.
6,056,181 A 5/2000 Chuang
6,112,831 A 9/2000 Gustafsson
6,131,787 A 10/2000 Curtis
6,145,723 A 11/2000 Gupta
6,149,046 A 11/2000 Ho et al.
6,161,744 A 12/2000 Mukoyama et al.
6,199,739 B1 3/2001 Mukoyama et al.
6,308,879 B1 10/2001 Wang
6,364,192 B1 4/2002 Lin
6,371,348 B1 4/2002 Canlas et al.
6,394,332 B2 5/2002 Akiba
6,431,428 B1 8/2002 Chen
6,557,743 B2 5/2003 Schuster
6,585,142 B1 7/2003 Chen
6,598,775 B1 7/2003 Chen
6,598,777 B2 7/2003 Osuga et al.
6,641,018 B2 11/2003 Akiba
6,672,497 B2 1/2004 Lin
6,691,907 B1 2/2004 Chang
6,769,591 B2 8/2004 Yamamoto et al.
6,789,718 B2 9/2004 Canlas et al.
6,796,475 B2 9/2004 Adams
6,805,272 B1 10/2004 Sen-Mu et al.
D498,127 S 11/2004 Leasure
6,814,156 B2 11/2004 Dieterle et al.
6,908,021 B1 6/2005 Wang
6,913,180 B2 7/2005 Schuster
6,918,527 B2 7/2005 Hakozaki et al.
D509,418 S 9/2005 Leasure
6,948,647 B1 9/2005 Niblett et al.
6,966,477 B1 11/2005 Chien-Kuo et al.
6,971,567 B1 12/2005 Cannaliato et al.
6,974,061 B2 12/2005 Adams et al.
6,974,062 B2 12/2005 Akiba
6,978,920 B2 12/2005 Hamada et al.
7,000,294 B2 2/2006 Kakuda et al.
D520,839 S 5/2006 Miwa
7,055,728 B2 6/2006 Lin
7,086,573 B1 8/2006 Wen
7,100,475 B1 9/2006 Rufolo, Jr.
7,134,586 B2 11/2006 McGee et al.
7,137,541 B2 11/2006 Baskar et al.
7,138,595 B2 11/2006 Berry et al.
7,140,524 B2 11/2006 Hung et al.
7,143,921 B2 12/2006 Hakozaki et al.
7,165,305 B2 1/2007 Kenney et al.
7,204,403 B2 4/2007 Kenney et al.
7,210,607 B2 5/2007 Niblett et al.
D551,931 S 10/2007 Leasure
7,285,877 B2 10/2007 Gorti et al.
D556,003 S 11/2007 Buck
7,303,103 B2 12/2007 Wang
7,322,506 B2 1/2008 Forster
D562,664 S 2/2008 Buck
7,328,826 B2 2/2008 Shkolnikov
7,331,403 B2 2/2008 Berry et al.
7,410,084 B1 8/2008 Reed
7,413,103 B1 8/2008 Ho et al.
7,451,735 B2 11/2008 Riley et al.
7,469,811 B2 12/2008 Shima et al.
7,470,081 B2 12/2008 Miyahara et al.
7,484,647 B2 2/2009 Yang
7,494,036 B2 2/2009 Shima et al.
7,497,058 B2 3/2009 Mårtensson
7,503,401 B2 3/2009 Gross et al.
7,506,787 B2 3/2009 Wu et al.
7,513,402 B2 4/2009 Miyashita et al.
7,516,532 B2 4/2009 Wojcicki
7,552,852 B2 6/2009 Haskins et al.
7,556,184 B2 * 7/2009 Brendel ..... B25C 1/06 227/132
7,559,447 B2 7/2009 Chen et al.
7,565,992 B2 7/2009 Buetow
7,571,844 B2 8/2009 Bromley et al.
7,575,140 B2 8/2009 Jiang
7,575,141 B1 8/2009 Liang et al.
7,575,142 B2 8/2009 Liang et al.

(56) References Cited

U.S. PATENT DOCUMENTS 7,600,662 B2 10/2009 Nayrac et al.
7,637,408 B2 12/2009 Takahashi et al.
7,646,157 B2 1/2010 Cruise et al.
7,654,430 B2 2/2010 Cho et al.
7,686,199 B2 3/2010 Gross et al.
7,690,546 B2 4/2010 Cortez
7,708,505 B2 5/2010 Opsitos, Jr. et al.
7,726,536 B2 6/2010 Gross et al.
7,748,588 B2 7/2010 Osuga et al.
7,753,243 B2 7/2010 Brendel et al.
7,762,443 B2 7/2010 Tamura et al.
7,784,238 B2 8/2010 Bannister
7,788,997 B2 9/2010 Kozak et al.
7,789,169 B2 9/2010 Berry et al.
7,870,987 B1 1/2011 Zhang et al.
7,874,469 B2 1/2011 Liu
7,905,377 B2 3/2011 Krondorfer et al.
7,930,960 B2 4/2011 Duginske
7,934,565 B2 5/2011 Krondorfer et al.
7,934,566 B2 5/2011 Hlinka et al.
7,959,049 B2 6/2011 Dittrich et al.
7,975,893 B2 7/2011 Berry et al.
7,980,439 B2 7/2011 Akiba et al.
7,980,441 B2 7/2011 Dittrich et al.
7,997,467 B2 8/2011 Hirabayashi et al.
8,011,441 B2 9/2011 Leimbach et al.
8,011,547 B2 9/2011 Leimbach et al.
8,011,549 B2 9/2011 Berry et al.
8,025,197 B2 9/2011 Brendel et al.
8,042,717 B2 10/2011 Lam et al.
RE42,987 E 12/2011 Akiba
8,091,752 B2 1/2012 Jian et al.
8,104,658 B2 1/2012 Yu
8,123,099 B2 2/2012 Kenney et al.
8,136,606 B2 3/2012 Krondorfer et al.
8,167,182 B2 5/2012 Shima et al.
8,172,814 B2 5/2012 Cane'
8,230,941 B2 7/2012 Leimbach et al.
8,231,039 B2 7/2012 Buck et al.
8,240,534 B2 8/2012 Hirabayashi
8,256,528 B2 9/2012 Oesterle et al.
8,267,296 B2 9/2012 Leimbach et al.
8,267,297 B2 9/2012 Leimbach et al.
8,286,722 B2 10/2012 Leimbach et al.
8,292,143 B2 * 10/2012 Lee ..... B25C 1/008 227/8
8,302,833 B2 * 11/2012 Gross ..... B25C 1/008 227/134
8,313,012 B2 11/2012 Shima et al.
8,347,978 B2 * 1/2013 Forster ..... B25C 1/06 173/1
8,381,830 B2 2/2013 Puzio et al.
8,387,718 B2 3/2013 Leimbach et al.
8,387,846 B2 3/2013 Francis et al.
8,408,327 B2 4/2013 Forster et al.
8,434,566 B2 5/2013 Forster et al.
8,439,242 B2 5/2013 Tanji et al.
8,505,798 B2 8/2013 Simonelli et al.
8,534,527 B2 9/2013 Brendel et al.
8,602,282 B2 12/2013 Leimbach et al.
8,631,986 B2 1/2014 Hlinka et al.
8,684,246 B2 4/2014 Liang et al.
8,763,874 B2 7/2014 McCardle et al.
8,777,081 B2 7/2014 Chen et al.
8,827,132 B2 9/2014 Mina et al.
8,925,233 B2 1/2015 Thordsen
8,991,675 B2 3/2015 Liang et al.
8,997,744 B2 4/2015 Ho et al.
9,010,493 B2 4/2015 Jagdale et al.
9,038,305 B2 5/2015 Volfson
9,120,028 B2 9/2015 Wilson
9,126,319 B2 9/2015 Gross et al.
9,194,637 B2 11/2015 Mather
9,346,156 B1 5/2016 Fago
9,346,158 B2 5/2016 Garber et al.
9,399,281 B2 7/2016 Brendel et al.
9,459,075 B1 10/2016 Hatcher
9,469,021 B2 10/2016 Gregory et al.
9,486,904 B2 11/2016 Gregory et al.
9,498,871 B2 11/2016 Gregory et al.
9,527,196 B2 12/2016 Segura
9,577,493 B2 2/2017 Ekstrom et al.
9,643,200 B2 5/2017 Belanger
9,643,305 B2 5/2017 Gregory et al.
9,649,755 B2 5/2017 Gregory et al.
9,676,088 B2 6/2017 Leimbach et al.
9,744,657 B2 8/2017 Baron et al.
9,827,658 B2 11/2017 Gregory et al.
9,868,196 B2 1/2018 Chien
10,265,840 B2 4/2019 Anstett et al.
10,434,634 B2 10/2019 Garber
10,562,163 B2 2/2020 Akiba
10,604,172 B2 3/2020 Yoon et al.
10,661,470 B2 5/2020 Bauer et al.
2004/0222266 A1 11/2004 Kakuda et al.
2005/0217416 A1 10/2005 Berry et al.
2005/0218180 A1 10/2005 Gross et al.
2006/0231582 A1 10/2006 Hong et al.
2008/0054043 A1 3/2008 Beales
2008/0296340 A1 12/2008 Wang
2008/0302852 A1 * 12/2008 Brendel ..... B25C 1/06 227/131
2009/0108046 A1 4/2009 Huang
2009/0120281 A1 5/2009 Yang
2009/0145520 A1 6/2009 Opsitos, Jr. et al.
2009/0152323 A1 6/2009 Lin
2009/0266867 A1 10/2009 Mina et al.
2010/0057014 A1 3/2010 Cane
2010/0116863 A1 5/2010 Suda
2010/0301091 A1 12/2010 Liang et al.
2010/0308098 A1 12/2010 Francis et al.
2011/0057014 A1 3/2011 Yang et al.
2011/0114692 A1 5/2011 Liang et al.
2011/0132959 A1 6/2011 Hlinka et al.
2011/0198381 A1 8/2011 McCardle et al.
2011/0215131 A1 9/2011 Liang
2011/0278342 A1 11/2011 Kuo
2011/0315414 A1 12/2011 Kuntner et al.
2011/0315840 A1 12/2011 Connolly et al.
2012/0074194 A1 * 3/2012 Miller ..... B25C 1/04 227/8
2012/0187177 A1 7/2012 Myburgh et al.
2013/0032368 A1 2/2013 Zhang et al.
2013/0153254 A1 6/2013 Liang et al.
2013/0227869 A1 9/2013 Thordsen
2013/0240299 A1 9/2013 Jagdale et al.
2013/0306699 A1 11/2013 Baskar et al.
2013/0320059 A1 12/2013 Gregory et al.
2013/0320060 A1 12/2013 Gregory et al.
2013/0320063 A1 12/2013 Gregory et al.
2013/0320064 A1 12/2013 Gregory et al.
2013/0320065 A1 12/2013 Gregory et al.
2013/0320066 A1 * 12/2013 Gregory ..... B25C 5/162 227/126
2013/0320067 A1 12/2013 Gregory et al.
2013/0320068 A1 12/2013 Gregory et al.
2014/0069671 A1 3/2014 Leimbach et al.
2014/0097223 A1 * 4/2014 Baron ..... B25C 5/15 227/131
2014/0158739 A1 6/2014 Grazioli et al.
2014/0325886 A1 11/2014 Mather
2014/0361066 A1 * 12/2014 Liu ..... B25C 1/005 227/119
2014/0373329 A1 12/2014 Volfson
2015/0096776 A1 * 4/2015 Garber ..... B25C 1/008 173/1
2015/0122867 A1 5/2015 Segura
2015/0352702 A1 12/2015 Chien
2016/0129573 A1 5/2016 Anstett et al.
2017/0066116 A1 * 3/2017 Garber ..... B25C 1/06
2017/0232600 A1 8/2017 King, Jr.
2018/0001454 A1 * 1/2018 Jaskot ..... B25C 1/008
2018/0001456 A1 * 1/2018 Garber ..... B25C 1/008
2018/0015600 A1 * 1/2018 Akiba ..... B25C 1/008

(56) References Cited

U.S. PATENT DOCUMENTS

| | | | | |
|---|---|---|---|---|
| 2018/0281840 | A1* | 10/2018 | Yoon | B62D 1/192 |
| 2018/0333888 | A1 | 11/2018 | Bauer et al. | |
| 2019/0091844 | A1* | 3/2019 | Akiba | B25C 1/06 |
| 2019/0299380 | A1 | 10/2019 | Meyer et al. | |

FOREIGN PATENT DOCUMENTS

| | | | |
|---|---|---|---|
| EP | 931625 | A2 | 7/1999 |
| EP | 1206337 | B1 | 10/2004 |
| EP | 1207017 | B1 | 8/2006 |
| EP | 1798003 | A1 | 6/2007 |
| EP | 1884322 | A1 | 2/2008 |
| EP | 1795305 | B1 | 2/2010 |
| EP | 1864759 | B1 | 10/2010 |
| EP | 2105259 | B1 | 6/2011 |
| EP | 2065137 | B1 | 11/2011 |
| EP | 2105258 | B1 | 4/2012 |
| EP | 2441552 | A2 | 4/2012 |
| EP | 2687334 | B1 | 6/2016 |
| EP | 2711135 | B1 | 7/2016 |
| EP | 2301718 | B1 | 12/2016 |
| GB | 602455 | A | 5/1948 |
| JP | S5499276 | A | 8/1979 |
| JP | H06246649 | A | 9/1994 |
| JP | 2000354981 | A | 12/2000 |
| JP | 2002210676 | A | 7/2002 |
| WO | 2009/046076 | A1 | 4/2009 |
| WO | 2015164032 | A1 | 10/2015 |

OTHER PUBLICATIONS

Extended European Search Report, dated Jan. 28, 2020.
International Search Report and Written Opinion dated Nov. 2, 2017 in corresponding International Patent Application No. PCT/US2017/039988.
Office Action in corresponding European Patent Application No. 17737706.6 dated Feb. 13, 2020.
International Search Report and Written Opinion dated Oct. 12, 2017 in corresponding International Patent Application No. PCT/US2017/039981.
EESR dated Mar. 28, 2018.
Extended European Search Report dated Mar. 29, 2018.
Extended European Search Report dated Nov. 20, 2017.
Copenheaver, Blaine R.—International Search Report and Written Opinion re: related application No. PCT/US2017/039723—dated Sep. 6, 2017—7 pages.
Extended European Search Report, dated Dec. 3, 2018.
EP Search Report, dated Jan. 4, 2018.
Hilti DX460—at least as early as Mar. 17, 2016.
Hilti DX351—at least as early as Mar. 17, 2016.
RAMSET XT540—at least as early as Mar. 17, 2016.
Hilti GX120—at least as early as Mar. 17, 2016.
Simpson GCN-MEPMAG—at least as early as Mar. 17, 2016.
RAMSET TRACKFAST—at least as early as Mar. 17, 2016.
T3 RAMSET—at least as early as Mar. 17, 2016.
Hilti GX2—at least as early as Mar. 17, 2016.
Office Action in corresponding European Patent Application No. 17737194.5 dated Feb. 13, 2020.

* cited by examiner

DRIVER REBOUND PLATE FOR A FASTENING TOOL

CROSS-REFERENCE TO RELATED APPLICATIONS

The present application claims priority under 35 U.S.C. § 119 to U.S. Provisional Application Ser. No. 62/356,999 entitled Driver Rebound Plate for a Fastening Tool filed on Jun. 30, 2016, and U.S. Provisional Application Ser. No. 62/357,511 entitled Driver Rebound Plate for a Fastening Tool filed on Jul. 1, 2016, which are herein incorporated by reference in their entirety.

BACKGROUND OF THE INVENTION

Field of the Invention

The present disclosure relates to preventing fastener driver rebound along a fastener drive axis in fastening tools such as nailers and cordless tools.

Description of the Related Art

This section provides background information related to the present disclosure which is not necessarily prior art.

In a fastening tool, fasteners, such as nails, are driven into a workpiece by a driver blade or driver through a process known as a "drive" or "drive cycle". Generally, a drive cycle involves the driver striking a fastener head during a drive stroke and returning to a home position during a return stroke. To absorb the force of the driver movement during the return stroke, after a fastener is driven into a workpiece, bumpers are provided at the front and rear of the drive path. At the end of a drive, the driver may have residual momentum or leftover kinetic energy that compresses the front bumpers as the front bumpers absorb the force of the driver. The front bumpers will return this energy to the driver sending the driver rearward until the driver impacts the rear bumpers. A stop member and home magnet should hold the driver in the home position and prevent the driver from traveling forward toward the next fastener waiting to be driven; however, in some instances the driver retains an excess amount of kinetic energy after firing a first fastener, such that the driver bounces off of the rear bumpers with enough speed to skip over the stop member. If the driver skips over the stop member, the driver can travel forward, along the drive path, and break free the next or second fastener from a collated strip of fasteners, and push the second fastener toward the nosepiece of the fastening tool. The second fastener can be inadvertently pushed into the nosepiece while the driver is returned to the home position. A third fastener, which is intended to be driven after the driver is returned to the home position, is allowed to advance into the drive path, resulting in two fasteners in the drive path. The second and third fasteners would abut each other in the nosepiece of the tool. As such, when the tool is fired again, both the second and third fasteners will be driven simultaneously, often resulting in a misfire, nail jam, bent nails and/or damage to the fastening tool.

Accordingly, there is a need to prevent the driver from rebounding into the drive path and striking additional fasteners at the end of a drive cycle.

SUMMARY OF THE INVENTION

In an embodiment of the present invention a fastening tool includes a housing having a housing interior, a forward end, a rearward end, and a support member disposed in the rearward end. The rearward end of the housing can include a rear housing cover removably attached to the housing. A drive track is defined within the housing interior and a driver is reciprocally mounted for movement within the drive track, along a fastener drive axis, to drive a fastener during a drive stroke. The driver has a blade at the front end for striking the head of a fastener during the drive stroke, and a rear end axially opposite to the front end. An elastically deformable member is operatively connected to the support member in the rearward end of the housing and bearing against a rearward end surface of the housing. A dampening member can be disposed between the elastically deformable member and the rearward end surface of the housing.

The elastically deformable member, or driver rebound plate is configured to receive an impact from the rear end of the driver during a return stroke and deflect the driver out of the drive axis toward a stop member disposed at a forward end of the housing. The stop member is configured to receive the driver blade or front end of the driver in a home position. The elastically deformable member or rebound plate includes a mounting portion at a first end thereof slidingly fastened to the support member and a bearing portion at a second end thereof disposed against the rearward end surface. The mounting portion and the bearing portion are slidably movable with respect to the drive axis upon impact of the driver on the impact portion. A retaining portion is disposed adjacent to the mounting portion and includes a retaining tab that projects outwardly to wedge the dampening member between the rearward end surface and the driver rebound plate. An impact portion is disposed between the retaining portion and the bearing portion and can be bent at an oblique angle with respect to the drive axis. The impact portion can have an impact face for receiving the impact of the driver and a dampening face opposite the impact face for supporting a dampening member.

The rebound plate can be formed from a metal or alloy, including but not limited to steel. Additionally, the steel or metal can be heat-treated.

The dampening member can be formed from an impact absorbing material having a polymeric, rubber or plastic properties, including, but not limited to a foam, such as the rubber-like foam CELLASTO®.

The driver rebound plate can be an elastically deformable, elongated body of uniform thickness, formed of a heat-treated metal. The driver rebound plate can be arranged in the housing or a rear housing cover to deflect the driver blade or driver out of the fastener drive axis during a return stroke. The driver rebound plate can have a mounting portion, to mount the plate to a housing support member, at a first end thereof and a bearing portion at a second end thereof. A retaining portion is disposed between the mounting portion and the bearing portion and adjacent to the mounting portion. An impact portion is disposed between the retaining portion and the bearing portion. The impact portion can be bent at an oblique angle thereby forming a sloping surface with respect to the retaining portion. In a fastening tool, the impact portion is also configured to have an oblique angle with respect to the drive axis.

The mounting portion includes a slot to accommodate sliding movement of the mounting portion with respect to the support member. The retaining portion can be lanced to partially cut out a retaining tab. The retaining tab is bent to project outwardly and serves to prevent forward or sliding movement of the dampening member when the dampening member is in a position on the impact portion.

In an embodiment, the fastening tool includes a method of a controlling rebound of the driver including providing a driver reciprocally mounted for movement within a drive track along a drive axis to drive a fastener during a drive stroke, the driver having a front end and a rear end; providing a driver rebound plate having an impact portion adapted to receive an impact from the rear end of the driver during a return stroke; providing a dampening member to absorb the impact from the driver, providing a stop member to receive the front end of the driver in a home position; guiding the driver along the drive axis to contact the driver rebound plate; deflecting the rear end of the driver out of alignment with the drive axis during the return stroke; and guiding the front end of the driver toward the stop member. The step of providing a driver rebound plate includes providing an impact portion obliquely angled with respect to the drive axis.

BRIEF DESCRIPTION OF THE DRAWINGS

Embodiments of the invention will now be described, by way of example only, with reference to the accompanying schematic drawings.

DESCRIPTION OF THE INVENTION

Figure 1:
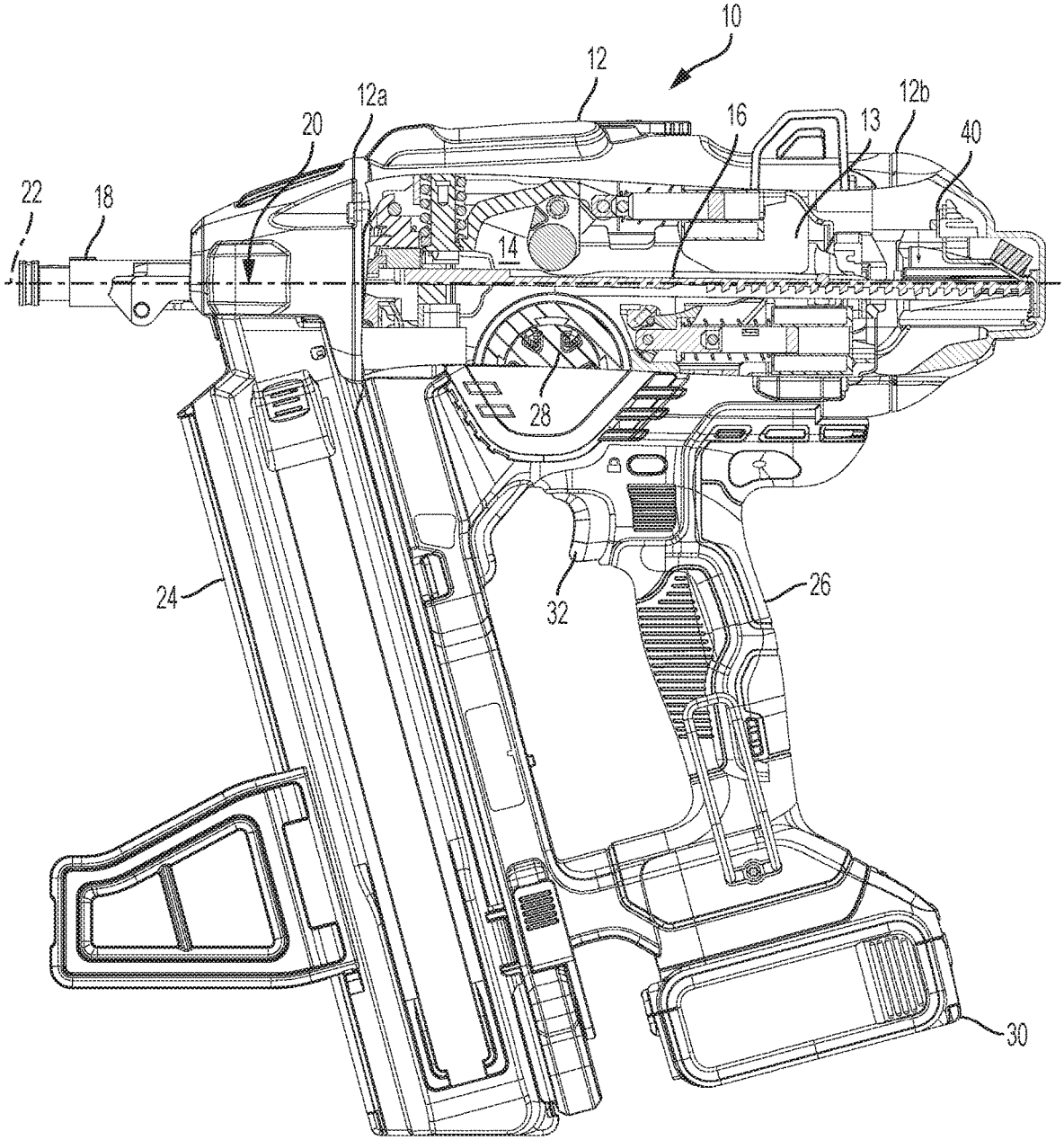
FIG. 1 is a partial sectional view of the fastening tool and housing according to an embodiment of the present invention.

Referring to FIGS. 1-2, a fastening tool including a rebound preventer, such as a driver rebound plate, for the fastener driver. The driver rebound plate prevents the driver from bouncing forward in the tool, toward the nosepiece, after a fastener has been driven, or the tool fired.

Referring now to the Drawings and particularly to FIG. 1, a fastening tool 10 in accordance with an embodiment of the present invention includes a housing 12 and a fastener drive system 14 disposed in the housing. The housing 12 has a forward end 12*a* and a rearward end 12*b* defining a housing interior 13. The fastener drive system 14 includes a driver 16 for driving fasteners along a drive path to a nosepiece 18, and into a work surface. The driver 16 is reciprocally mounted for movement within a drive track 20 carried by the housing 12 along a fastener drive axis 22 to drive a fastener during a drive stroke. The driver 16 has a front end 16*a* including a driver blade for striking a fastener during a drive stroke and a rear end 16*b* for striking the driver rebound plate. The rear end is at an axially opposite end of the driver from the front end. The fasteners can be temporarily stored in a magazine 24 which is connected to the drive track 20 and also supported at a handle 26 used by an operator to manipulate the fastening tool 10. The fastener drive system 14 also includes a motor 28 powered by a battery 30 and operatively associated with the driver 16 to drive the fasteners. A trigger 32 is manually depressed by the operator to actuate operation of the fastening tool. The battery is releasably connected to the handle and provides operative electrical power for operation of the fastening tool 10.

Although the embodiments of the fastening tool of the present invention depicted in the Drawings are shown as concrete nailers, it will be appreciated that the present invention can be incorporated in any fastening tool, for example, a high-powered cordless nailer and including, without limitation, staplers and other nailers.

Figure 2A:
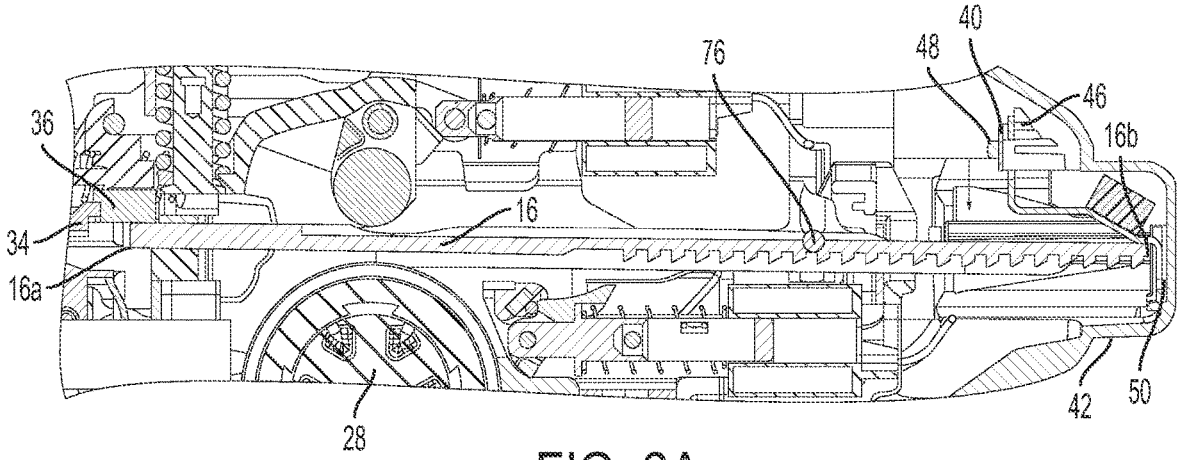
FIG. 2A illustrates an embodiment of tool housing of FIG. 1 showing an active driver during a driver return stroke, engaged with a driver rebound plate.
Figure 2B:
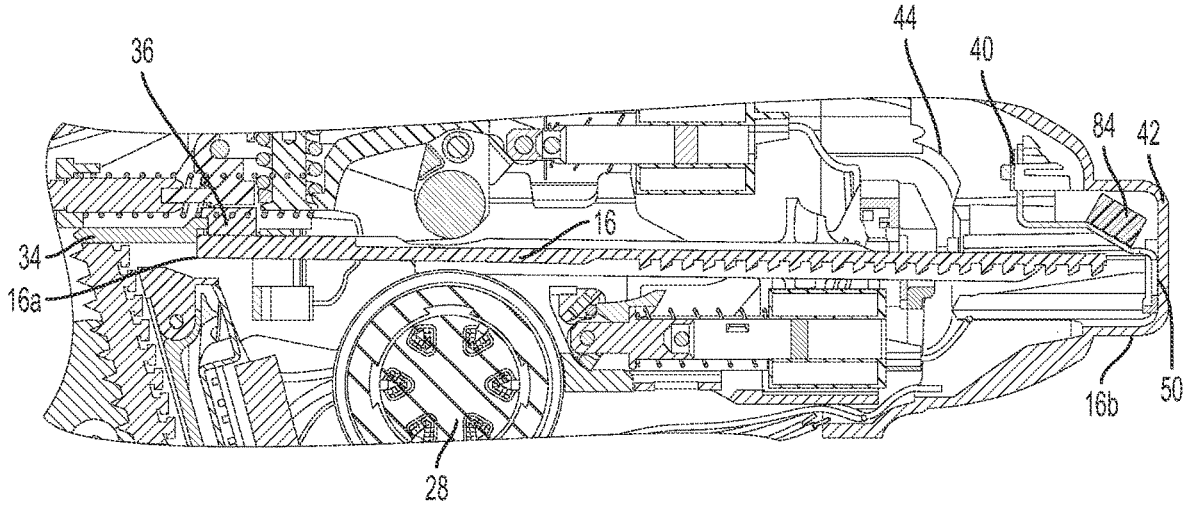
FIG. 2B illustrates an embodiment of the tool housing of FIG. 1 showing the driver in the home position, engaged with a stop member.

Before each fastener is driven into a workpiece, the driver 16 must be positioned in the home position as shown in FIG. 2B. The home position is the position wherein a front face portion or the front end 16*a* of the driver 16 is in abutment with a stop member 34 and is available to begin a fastener driving cycle. The stop member 34 is disposed at a forward end 12*a* of the housing and configured to receive the front end 16*a* of the driver 16 in a home position and prevent the driver from moving forward down the drive path until the fastening tool 10 is activated again by the operator. In a home position, the front end 16*a* of the driver 16 can be reversibly magnetically held by a home magnet 36 adjacent to the nosepiece 18. For example, as shown in FIG. 2B, the front end 16*a* of the driver 16 is proximate to the home magnet 36. In an embodiment, the home magnet 36 can magnetically attract the front end 16*a* toward a home seat 38 against which the front end 16*a* can rest. In other embodiments, the home position can be configured such that the driver is affected by the magnetic force of the home magnet 36, but not held or in direct physical contact with the home magnet itself.

The stop member 34 is located in the nosepiece 18 of the fastening tool. In an embodiment, the stop member 34 can be a portion of, or a piece attached to, the nosepiece 18. In an embodiment, the material used to construct the stop member 34 can be a hard and/or hardened material and can be impact resistant to avoid wear. Both the driver 16 and stop member 34 can be investment cast 8620 carbonized steel. In an embodiment, the stop member can be made of case hardened AISI 8620 steel, or other hardened material, such as used for the nosepiece, or other part which is resistant to wear from moving parts or moving fasteners.

As shown in FIGS. 2A and 2B, to prevent the driver 16 from skipping over the stop member 34 and inadvertently traveling back down the drive path after a drive stroke, a spring-loaded body, such as the driver rebound plate 40 is provided in the rear portion of the tool, such as, for example, within the housing end cap or within a rear housing cover 42. The rear housing cover 42 can be connected to the rearward end 12*b* of the housing 12 and have a cover interior 44 that is open to the housing interior 13. The rear housing cover 42 can have a support member 46 that projects from an inner surface of the cover interior. The inner surface of the cover interior can be, for example, a rearward end surface 50. Alternatively, a support member can be disposed on a surface of the rearward end 12*b* of the housing 12. The driver rebound plate 40 can be can be attached to the support member 46 at a position that allows the driver rebound plate to receive the impact from the driver 16 on the return stroke. Further, the driver rebound plate can be attached to the support member 46 by a shoulder bolt 48 or other fastening means in a manner that allows the driver rebound plate to move up and down with respect to the drive axis 22 and/or the support member 46. In an embodiment, the driver rebound plate 40 is an elastically deformable member operatively connected to the support member 46 and bearing against a rearward end surface 50 of the rear housing cover 42 or the rear surface of the housing.

Figure 3:
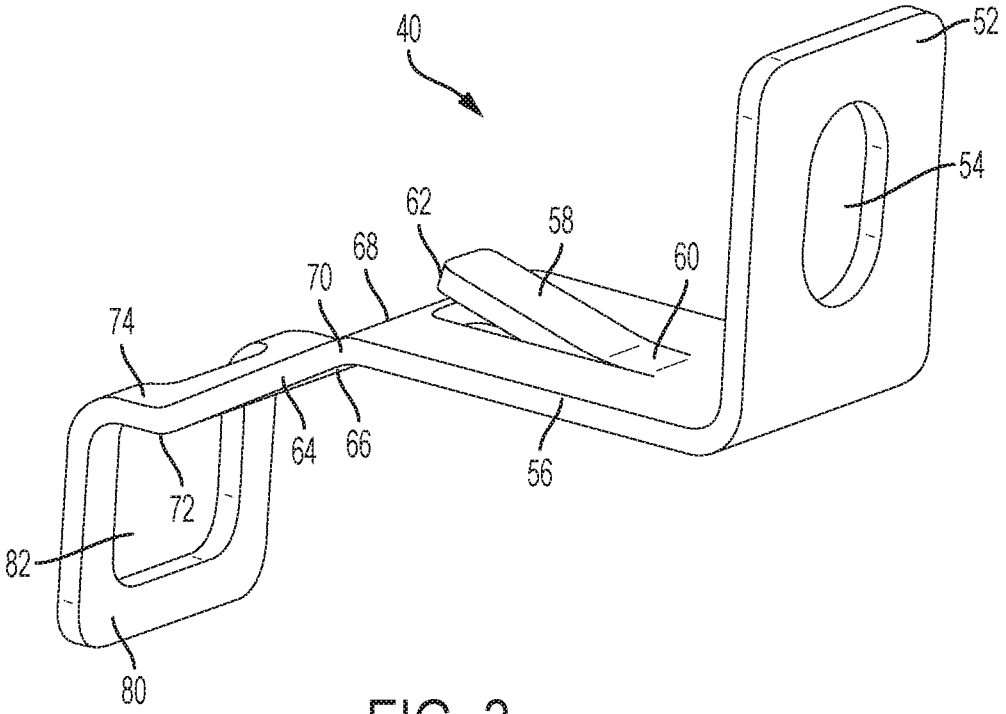
FIG. 3 is a perspective view of the driver rebound plate.

As shown in FIG. 3, the driver rebound plate 40 can be an elongated body of rectangular cross-section having a pair of flanges disposed at opposite ends of the body and a plurality of intermediate portions disposed between the pair of flanges. The flanges serve to affix the driver rebound plate 40 in the rear housing cover 42, while the intermediate portions service to receive and support dampening of the driver impact.

FIG. 3 illustrates the first flange as a mounting portion 52 through which the driver rebound plate is attached to the support portion 46. The mounting portion 52 can have a planar body and include an aperture in the form of a slot 54. The slot 54 can have an elongated shape that allows for movement of the mounting member 52 in a radial direction with respect to the fastener drive axis 22 when the driver impacts the driver rebound plate 40.

The elongated body of the driver rebound plate 40 is bent at an angle substantially perpendicular to the direction of the mounting portion to form a retaining portion 56. The retaining portion 56 is one of the plurality of intermediate portions in the driver rebound plate. In an embodiment, the retaining portion 56 can be bent at a right angle to the mounting portion. The retaining portion 56 can be designed to extend in a direction parallel to the drive axis. A center area of the retaining portion 56 can be lanced and bent outward to form a retaining tab 58. The retaining tab 58 is bent outward in a direction toward the mounting portion 52. The retaining tab 58 has a bend portion 60 and a free end portion 62. The bend portion 60 is proximal to the mounting portion 52 and the free end portion 62 is proximate to an intermediate impact portion 64.

The impact portion 64 of the driver rebound plate 40 is adjacent to the retaining portion 56 and defines a driver impact region. The impact portion 64 is designed to receive an impact from the rear end 16*b* of the driver 16 during a return stroke. The impact portion 64 is bent to form a sloping surface with respect to the retaining portion. In the fastening tool 10, the impact portion 64 forms an oblique angle with respect to the drive axis 22. In the illustrated embodiment, the impact portion 64 includes a single sloping surface that forms an oblique angle with respect to the drive axis 22. In alternative embodiments, the impact portion 64 can include a plurality of sloping surfaces in the impact region. The impact potion 64 includes an impact face 66 and an opposing dampening face 68. The impact face 66 receives the impact of the driver 16 during the return stroke, while the dampening face 68 supports the dampening member 84 within the rear housing cover 42. The impact portion 64 has a proximal end 70 adjacent to the retaining portion 56 and a distal end 72.

A distal end 72 of the impact portion 64 includes a transition portion 74 between the impact portion 64 and the bearing portion 80. The transition portion defines rest stop 74 that is designed to support the rear end 16*b* of the driver 16 when the driver is in the process of returning to the home position. The rest stop is formed substantially parallel to the retaining portion 56 and receives the rear end 16*b* of the driver 16 after the driver strikes the impact portion 64. When the driver 16 strikes the impact portion 64, the angular or sloping configuration thereof deflects the rear end 16*b* of the driver out of alignment with the drive axis 22. The continued rearward motion of the driver 16 against the sloped impact portion 64 forces the rear end 16*b* of the driver to slide downward or in a direction away from the retaining portion 56, to a position contacting the rest stop 74. The rest stop 74 limits the deflection of the driver 16 around the driver pivot point 76 (FIG. 2A) to a predetermined amount, such as, for example, the length of the impact portion 64. As a result, the driver 16 passes through the impact region, to the transition region rest stop 74. At the rest stop, a rear end face 16*d* of the driver 16, opposite to the fastener striking face 16*c* of the driver, is free and not in contact with the driver rebound plate 40, thereby avoiding the need to overcome additional friction during the drive stroke.

Adjacent to the impact portion 64 of the driver rebound plate is the second flange or bearing portion 80 that bears against the inner surface of the rear housing cover 42. The bearing portion 80 secures the non-fastened end of the elongated body within the rear housing cover 42. The bearing portion 80 is configured to be located in a plane parallel to the plane of the mounting portion 52. The bearing portion 80 includes an aperture 82 that provides a clearance for the rear end 16*b* of the driver 16 when the driver is in the impact region. In addition, the aperture 82 also provides weight reduction for the driver rebound plate 40.

The slot 54 of the mounting portion 52 allows the mounting portion to be slidably movable with respect to the drive axis 22 upon impact of the driver 16 on the impact portion 64. Likewise, the restrained bearing portion 80 is also slidably movable with respect to the drive axis upon impact of the driver on the impact portion 64.

In an embodiment, the driver rebound plate 40 can be formed from a metal or alloy, such as steel. In another embodiment, the driver rebound plate 40 can be formed from heat treated steel. The steel can be heat treated to a hardness value of HRC 46-50.

Figure 4:
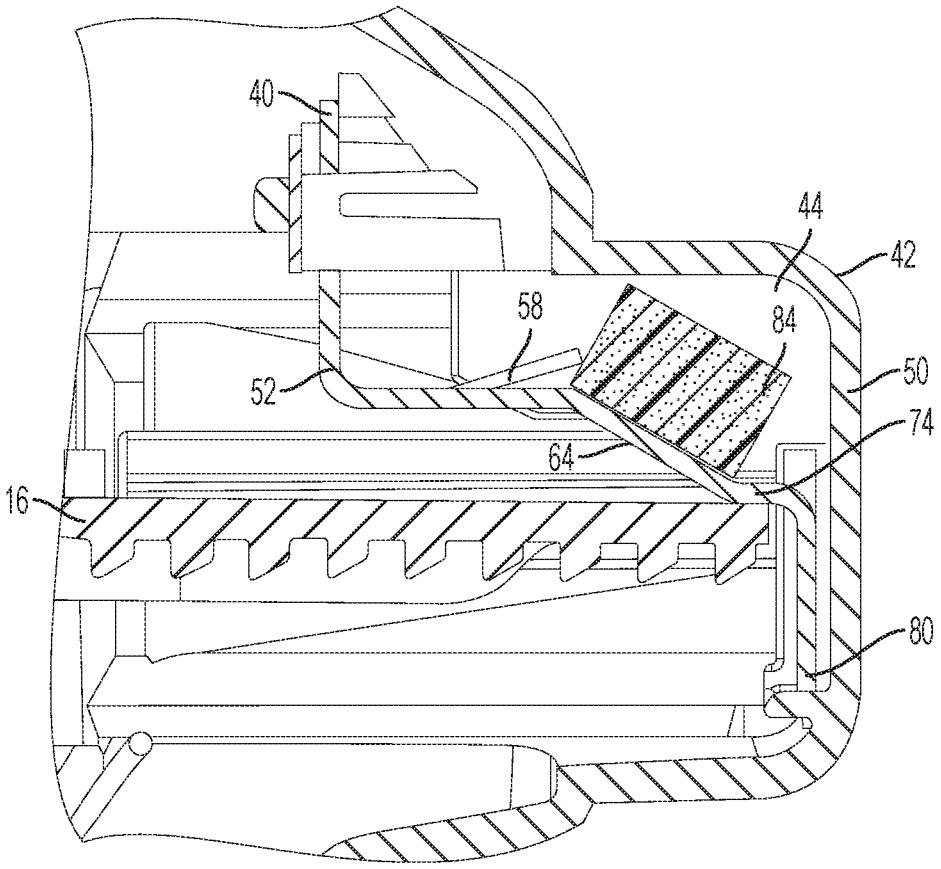
FIG. 4 is a perspective view of the rear housing cover showing an active driver engaged with the driver rebound plate, and a dampening member.
Figure 5:
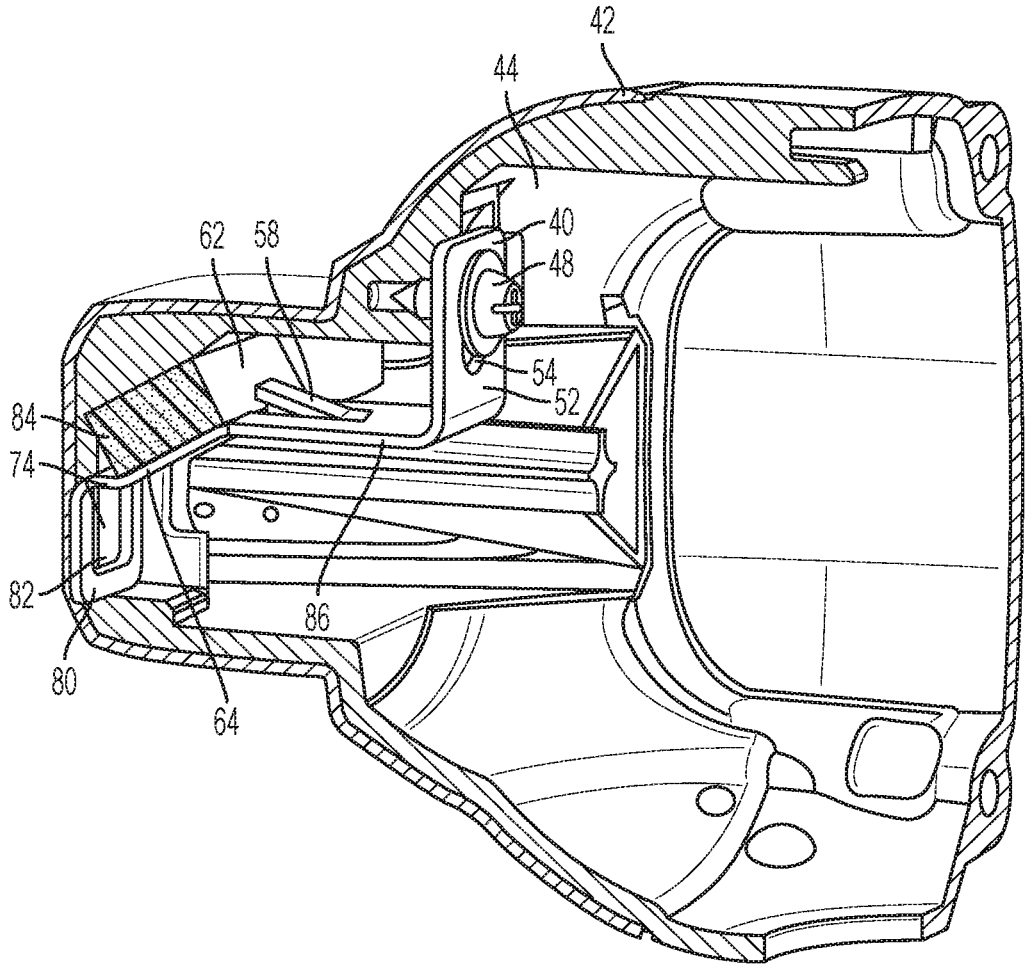
FIG. 5 is a side perspective view of the rear housing cover showing the driver rebound plate.

FIGS. 4, 5, 6 and 7 illustrate that the driver rebound plate 40 also supports a pad or dampening member 84 that dampens the impact of the driver 16 on the housing 12 during the return stroke. In particular, the impact portion 64 of the driver rebound plate 40 not only deflects the driver 16 out of alignment with the fastener drive axis 22, but is also adapted to support the dampening member 84. As shown in FIGS. 4 and 5, for example, the dampening member 84 is disposed between the driver rebound plate 40 and the rearward end surface 50 of the rear housing cover 42. In an embodiment, the dampening member 84 is supported by the dampening face 66 of the impact portion 64. In an embodiment, the free end 62 of the retaining tab 58 of the retaining portion 56 wedges the dampening member 84 between the driver rebound plate 40 and the rearward end surface 50 of the rear housing cover 42.

Figure 6:
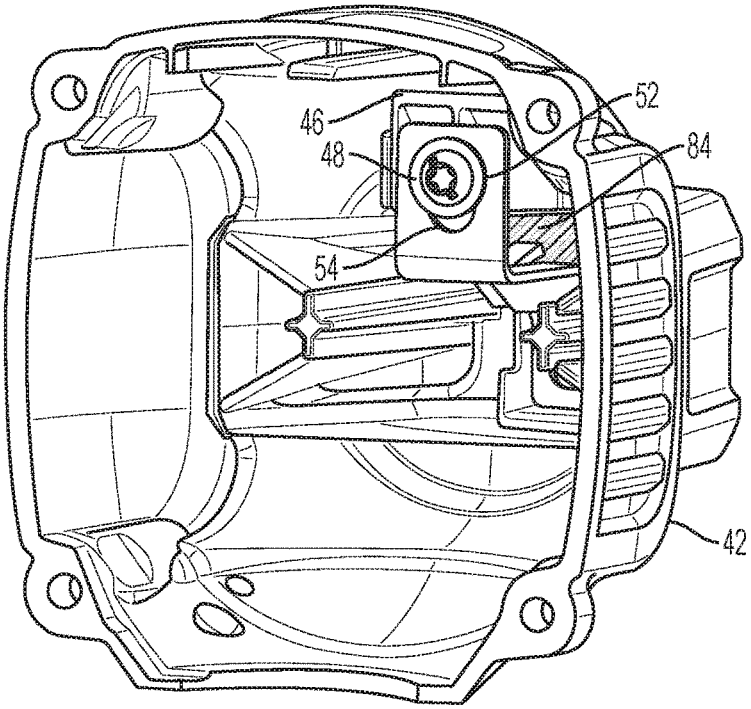
FIG. 6 is a right perspective view of the rear housing cover showing the driver rebound plate.
Figure 7:
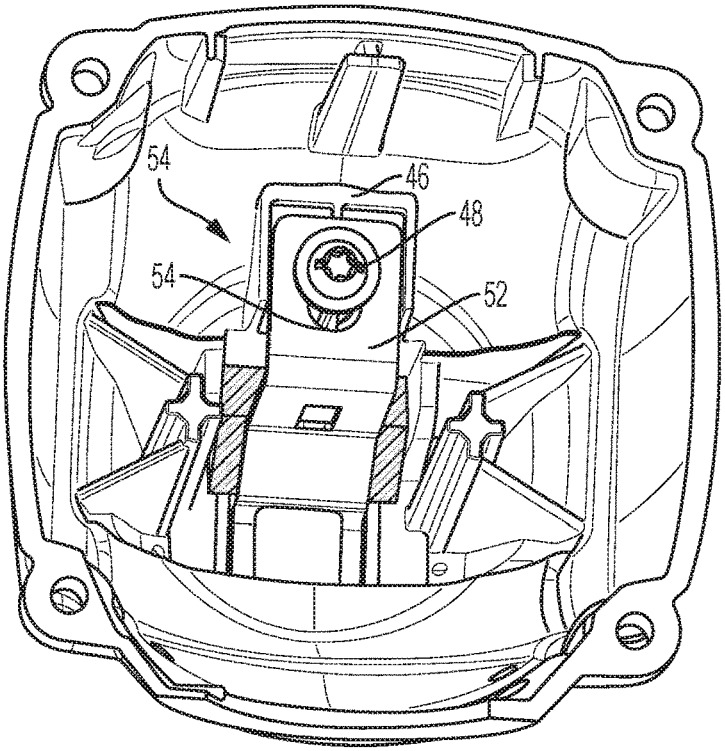
FIG. 7 is a bottom perspective view of the rear housing cover showing the driver rebound plate.

The dampening member can be formed from an impact absorbing material, such as, for example, a material having a polymer, a rubber, a plastic, a SORBOTHANE®, a synthetic viscoelastic urethane polymer, a synthetic viscoelastic polymer, a polymer, a foam, a memory foam, a gel, a thermoset plastic, PVC, natural rubber, synthetic rubber, closed cell foam, urethanes, resins, multiphase material, reinforced material, or fiber reinforced material. In an embodiment, the dampening member can be made from a rubber-like foam such as CELLASTO®. The dampening member can be attached to the driver rebound plate or located between the driver rebound plate and the interior of the end cap or inner surface of the rear housing cover as shown in FIGS. 6 and 7, to absorb at least a portion of the energy of the driver.

During the return stroke when the driver is moved rearward, the rear end 16*b* of the driver 16 will impact the driver rebound plate 40. The configuration of the driver rebound plate 40 interferes, by means of the impact portion 64, with the trajectory of the driver 16 and deflects the rear end 16*b* of the driver. The deflection of the rear end 16*b* of the driver 16 forces the front end 16*a* of the driver out of alignment with the drive path 22 and into abutment with the stop member 34, thereby placing the driver in the home position. By removing the front end 16*a* of the driver 16 from the drive axis 22 during the return phase, the front end of the driver is prevented from contacting any portion of the next or second fastener. The stop member 34 blocks the driver from moving forward toward the nosepiece and the driver is held in place by the magnet 36 until the operator begins the next fastening cycle.

Although a plate is illustrated as a rebound member, any spring-loaded element that can deflect the rear portion of the driver can be serve as a rebound member, including, but not limited to a projecting member. In addition, although the driver rebound plate is illustrated as mounted within the end cap of the fastening tool, the driver rebound plate or rebound member can be located along other portions of the driver path that direct the driver to a stop member to place the driver in the home position.

In an embodiment of the present invention, the fastening tool 10 can control rebound of the reciprocating driver by providing the rebound plate 40 to deflect or redirect the driver 16 toward a stop member 34 on or adjacent to the nosepiece 18, and out of the fastener drive path. The stop member 34 receives the front end 16*a* of the driver 16 when the driver is in a home position. In the home position, the front end 16*a* of the driver abuts the stop member 34 and can be reversibly magnetically held by the home magnet 36 adjacent to the nosepiece 18.

The driver rebound plate 40 is provided to receive an impact from the rear end 16*b* of the driver 16 during a return stroke and allow the driver to rebound forward toward the forward end of the housing 12. In particular, the impact portion 64 of the rebound plate 40 is provided to receive the impact from the driver 16. In an embodiment, the impact portion 64 includes a single sloped surface having an impact face 66 that forms an oblique angle with respect to the drive axis 22. The driver 16 is guided along the drive axis 22 to contact the driver rebound plate 40. Arranged between the impact portion 64 of the driver rebound plate 40 and an inner surface 50 of the end cap of the housing or rear housing cover 42 is a dampening member 84 that absorbs the impact from the driver 16. The impact from the driver 16 on the impact portion 64 of the driver rebound member 40, deflects the rear end 16*b* of the driver out of alignment with the drive axis 22 during the return stroke; and guides the front end of the driver toward the stop member 34. Abutment of the driver 16 with the stop member 34 positions the driver in the home position so that the driver is available for the next fastening cycle.

The driver rebound plate can prevent or greatly reduce the number of fastener jams experienced by the operator. Preventing minor or catastrophic jams decreases the wear and failure rates of the fastening tool components. Having fewer jams to clear from the fastening tool will also increase the productivity of the operator operating the tool.

While aspects of the present invention are described herein and illustrated in the accompanying drawings in the context of a fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

We claim:

1. A driver rebound plate comprising:

an elongated body having a mounting portion at a first end thereof and a bearing portion at a second end thereof;

a retaining portion between the mounting portion and the bearing portion, and adjacent to the mounting portion; and an impact portion of the elongated body disposed between the retaining portion and the bearing portion, the impact portion being bent at an oblique angle with respect to the retaining portion and the bearing portion and having an impact face that is configured to receive an impact force and redirect the impact force in a direction away from the retaining portion, wherein the mounting portion projects orthogonally from the retaining portion in a first direction and the bearing portion projects orthogonally with respect to the retaining portion in a second direction opposite to the first direction.

2. The driver rebound plate according to claim 1, wherein the mounting portion comprises a slot to accommodate sliding movement of the mounting portion.

3. The driver rebound plate according to claim 1, wherein the retaining portion comprises a retaining tab that projects outwardly.

4. The driver rebound plate according to claim 3, wherein the retaining tab projects outwardly from a lanced portion in the retaining portion.

5. The driver rebound plate according to claim 1, wherein the driver rebound plate has a uniform thickness.

6. The driver rebound plate according to claim 1, wherein the driver rebound plate is elastically deformable.

7. The driver rebound plate according to claim 1, wherein the driver rebound plate is formed from a metal.

8. The driver rebound plate according to claim 7, wherein the metal is heat treated.

9. The driver rebound plate according to claim 1, wherein the impact portion is adapted to receive an impact force.

10. The driver rebound plate according to claim 1, wherein the retaining portion comprises a retaining tab that projects outwardly, the retaining tab being a cutout portion of the elongated body.

11. The driver rebound plate according to claim 1, further comprising a rest stop connecting the impact portion and the bearing portion, the rest stop being substantially parallel to the retaining portion.

12. The driver rebound plate according to claim 1, wherein the mounting portion lies in a plane parallel to the bearing portion.

13. The driver rebound plate according to claim 1, wherein the elongated body has a uniform width along the entire length thereof.

14. A driver rebound plate comprising:

an elongated body having a uniform thickness, the elongated body having a mounting portion at a first end thereof and a bearing portion at a second end thereof;

a retaining portion between the mounting portion and the bearing portion, the retaining portion being adjacent to the mounting portion; and an impact portion of the elongated body disposed between the retaining portion and the bearing portion, the impact portion being bent at an oblique angle with respect to the retaining portion and the bearing portion and having an impact face that is configured to receive an impact force and redirect the impact force in a direction away from the retaining portion, wherein the mounting portion and the bearing portion are disposed on opposite sides of the elongated body, in a thickness direction, and wherein the mounting portion projects orthogonally from the retaining portion in a first direction and the bearing portion projects orthogonally with respect to the retaining portion in a second direction opposite to the first direction.

15. The driver rebound plate according to claim 14, wherein the retaining portion comprises a retaining tab that projects outwardly, the retaining tab being a cutout portion of the elongated body.

* * * * *